US007708591B2

(12) United States Patent
Ikumi et al.

(10) Patent No.: US 7,708,591 B2
(45) Date of Patent: May 4, 2010

(54) SHIELD CONNECTOR

(75) Inventors: Toru Ikumi, Makinohara (JP); Syuji Kimura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/125,090

(22) Filed: May 22, 2008

(65) Prior Publication Data

US 2009/0291588 A1 Nov. 26, 2009

(51) Int. Cl.
*H01R 9/05* (2006.01)

(52) U.S. Cl. ..... 439/578; 439/394

(58) Field of Classification Search ..... 439/394, 439/578–585

See application file for complete search history.

(56) References Cited

U.S. PATENT DOCUMENTS 5,205,761 A * 4/1993 Nilsson ..... 439/578
5,542,861 A * 8/1996 Anhalt et al. ..... 439/578

FOREIGN PATENT DOCUMENTS

JP 2002-319456 A 10/2002

* cited by examiner

*Primary Examiner*—Renee Luebke
*Assistant Examiner*—Larisa Tsukerman
(74) *Attorney, Agent, or Firm*—Sughrue Mion, PLLC

(57) ABSTRACT

A shield connector for a shielded cable including a shielding conductor provided on an outer periphery of a core wire through an insulator, and a sheath covering an outer periphery of the shielding conductor, the shield connector includes an inner metal terminal which connects to the core wire of the shielded cable, a tubular resin sleeve which receives the inner metal terminal therein and has an opening portion, a tubular outer metal terminal which receives the resin sleeve therein, has an opening portion, and is adapted to be connected to the shielding conductor. A press-contacting blade is provided on the inner metal terminal, and is adapted to be brought into press-contacting connection with the core wire from an upper side through the opening of the outer metal terminal and the opening of the resin sleeve. A support wall is formed integrally with the resin sleeve, and is disposed adjacent to the press-contacting blade of the inner metal terminal in a state that the inner metal terminal is received in the resin sleeve. The support wall has a guide portion for guiding the core wire into a central slot of the press-contacting blade by contacting the core wire before the press-contacting blade contacts the core wire when the core wire is to be press-fitted into the central slot from the upper side.

6 Claims, 7 Drawing Sheets

SHIELD CONNECTOR

BACKGROUND

This invention relates to a shield connector (e.g. an antenna plug connector) electrically connected to an end portion of a shielded cable such as a coaxial cable.

In the case of transmitting a high-frequency signal, a shielded cable and a shield connector compatible with high-frequency signals are used. The shielded cable with such shield connector is also used for transmitting high-frequency signals between on-vehicle equipments mounted on a vehicle such as an automobile. There has been an increasing demand for a compact design of such an on-vehicle shield connector.

Generally, a shielded cable includes a shielding conductor (a braided wire or the like) provided on an outer periphery of a core wire (conductor) through an insulator, and a sheath covering an outer periphery of the shielding conductor. On the other hand, a shield connector comprises an inner metal terminal for connection to the core wire, a tubular resin sleeve receiving the inner metal terminal therein, and a tubular outer metal terminal receiving the resin sleeve therein and adapted to be connected to the shielding conductor.

Generally, for assembling reasons and other reasons, a press-clamping portion is, in many cases, provided at that portion of the inner metal terminal to which the core wire is adapted to be connected. However, in some cases, a press-contacting blade is provided at the portion of the inner metal terminal adapted to be connected to the core wire. Patent Literature 1 discloses an example in which the core wire is connected to the inner metal terminal by the use of such a press-contacting blade.

In the case of connecting the core wire by the use of the press-contacting blade, a pair of inclined guide surfaces 200*c* jointly assuming a generally V-shape are usually formed at an inlet of a central slot 200*a* of the press-contacting blade 200 as shown in FIG. 8, and the core wire 101 can be easily guided into the central slot 200*a* by these inclined guide surfaces.

[Patent Literature 1] JP-A-2002-319456

Incidentally, with respect to the shield connector, there has been an increasing demand for a compact design as described above, and the portion of the shield connector at which the press-contacting blade is provided has also been required to be reduced in cross-sectional dimensions. Therefore, in the case where the press-contacting blade as shown in FIG. 8 is formed on the inner metal terminal, it has been difficult to secure the inclined guide surfaces 200*c*.

For example, when the angle θ between the inclined guide surfaces 200*c* is reduced so as to enable the core wire 101 to be easily guided into the central slot 200*a* while securing a sufficient length H2 of a straight portion of the central slot 200*a*, a height H1 of the press-contacting blade 200 must be increased. This prevents the inner metal terminal from being formed into a compact design. Also, when the angle θ between the inclined guide surfaces 200*c* is reduced so as to enable the core wire 101 to be easily guided into the central slot 200*a* while sacrificing the length H2 of the straight portion of the central slot 200*a*, there is a fear that the connecting performance for the core wire 101 may be adversely affected, although the height H1 of the press-contacting blade 200 can be reduced.

SUMMARY

This invention has been made in view of the above circumstances, and an object of the invention is to provide a shield connector in which a core wire can be easily guided into a central slot of a press-contacting blade even when the height of the press-contacting blade itself is limited.

The above object has been achieved by a shield connector of the present invention having features recited in the following Paragraphs (1) to (4).

(1) A shield connector for a shielded cable including a shielding conductor provided on an outer periphery of a core wire through an insulator, and a sheath covering an outer periphery of the shielding conductor, the shield connector comprising:

an inner metal terminal which connects to the core wire of the shielded cable;

a tubular resin sleeve which receives the inner metal terminal therein, and has an opening portion;

a tubular outer metal terminal which receives the resin sleeve therein, has an opening portion, and is adapted to be connected to the shielding conductor, wherein a press-contacting blade is provided on the inner metal terminal, and is adapted to be brought into press-contacting connection with the core wire from an upper side through the opening portion of the outer metal terminal and the opening portion of the resin sleeve;

wherein a support wall is formed integrally with the resin sleeve, and is disposed adjacent to the press-contacting blade of the inner metal terminal in a state that the inner metal terminal is received in the resin sleeve; and wherein the support wall has a guide portion for guiding the core wire into a central slot of the press-contacting blade by contacting the core wire before the press-contacting blade contacts the core wire when the core wire is to be press-fitted into a central slot from the upper side.

(2) Preferably, the guide portion has a groove which is formed in a widthwise-central portion of the support wall so as to correspond to the central slot of the press-contacting blade. A pair of inclined guide surfaces having a generally V-shape are formed at an inlet of the groove, and are disposed at a position higher than the press-contacting blade.

(3) Preferably, the inner metal terminal is formed of a metal sheet bent into a cylindrical tubular shape, and a rear half portion of the inner metal terminal in a longitudinal direction thereof is formed into an upwardly-open semi-tubular portion, and the press-contacting blade is disposed within the upwardly-open semi-tubular portion, with an inlet of the central slot directed upwardly. The support wall is formed into a U-shaped frame in which upper both ends thereof is connected to an inner surface of the resin sleeve so the U-shaped frame is hanged down therefrom, and a space is formed at the lower side of the support wall so that the semi-tubular portion passes through the space when the rear half portion of the inner metal terminal is inserted into the resin sleeve from the front side thereof.

(4) Preferably, the rear half portion of the inner metal terminal is inserted into the resin sleeve from the front side thereof, and is fixed to the resin sleeve, and the resin sleeve is inserted into the outer metal terminal from the front side thereof, and is fixed to the outer metal terminal, and in this condition the core wire of the shielded cable is brought into press-contacting connection with the press-contacting blade of the inner metal terminal through the opening portion of the outer metal terminal and the opening portion of the resin sleeve.

In the shield connector of the above Paragraph (1), the support wall is formed integrally with the resin sleeve receiving the inner metal terminal therein, and is disposed adjacent to the press-contacting blade. The guide portion is formed at the support wall, and when the core wire is to be press-fitted into the central slot of the press-contacting blade from the upper side, the guide portion contacts the core wire so as to guide the core wire into the central slot before the press-contacting blade contacts the core wire. Therefore, the core wire can be smoothly guided into the central slot of the press-contacting blade without the need for providing any inclined guide surface on the press-contacting blade itself. Therefore, the height of the press-contacting blade itself can be reduced, and the inner metal terminal can be reduced in cross-sectional dimensions. And besides, a straight portion of the central slot does not need to be sacrificed, and therefore the connecting performance for the core wire will not be lowered. Furthermore, since the core wire can be guided into the central slot of the press-contacting blade by the guide portion of the resin-made support wall, damage of the core wire due to die wear of the press-contacting blade formed by pressing can be prevented. Furthermore, the support wall is disposed adjacent to the press-contacting blade, and therefore the core wire can be supported by both of the press-contacting blade and the support wall, and even in the case where the press-contacting blade is formed of a thin metal sheet, the core wire can be supported in a stable manner.

In the shield connector of the above Paragraph (2), the groove serving as the guide portion is formed in the support wall, and is disposed in registry with the central slot of the press-contacting blade, and the pair of inclined guide surfaces jointly assuming the generally V-shape are formed at the inlet of the groove, and are disposed at the position higher than the press-contacting blade such that the inclined guide surfaces can contact the core wire so as to guide the core wire into the central slot of the press-contacting blade before the press-contacting blade contacts the core wire. Therefore, by setting the angle between the pair of inclined guide surfaces to a proper value, the easiness of the guiding of the core wire into the central slot can be determined. Furthermore, the core wire is supported by the central slot of the press-contacting blade and the groove of the support wall, and therefore the core wire can be supported in a more stable manner.

In the shield connector of the above Paragraph (3), the space for the insertion of the inner metal terminal thereinto is formed at the lower side of the U-shaped frame-like support wall, and therefore when mounting the inner metal terminal in the resin sleeve, the rear half portion of the inner metal terminal can be inserted into the resin sleeve from the front side thereof.

In the shield connector of the above Paragraph (4), the core wire of the shielded cable can be brought into press-contacting connection with the press-contacting blade of the inner metal terminal through the opening portion of the outer metal terminal and the opening portion of the resin sleeve. Therefore, the shielded cable can be easily connected to the press-contacting blade.

In the present invention, even when the height of the press-contacting blade itself is limited, the core wire can be easily guided into the central slot of the press-contacting blade.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A preferred embodiment of the present invention will now be described with reference to the drawings.

Figure 1:
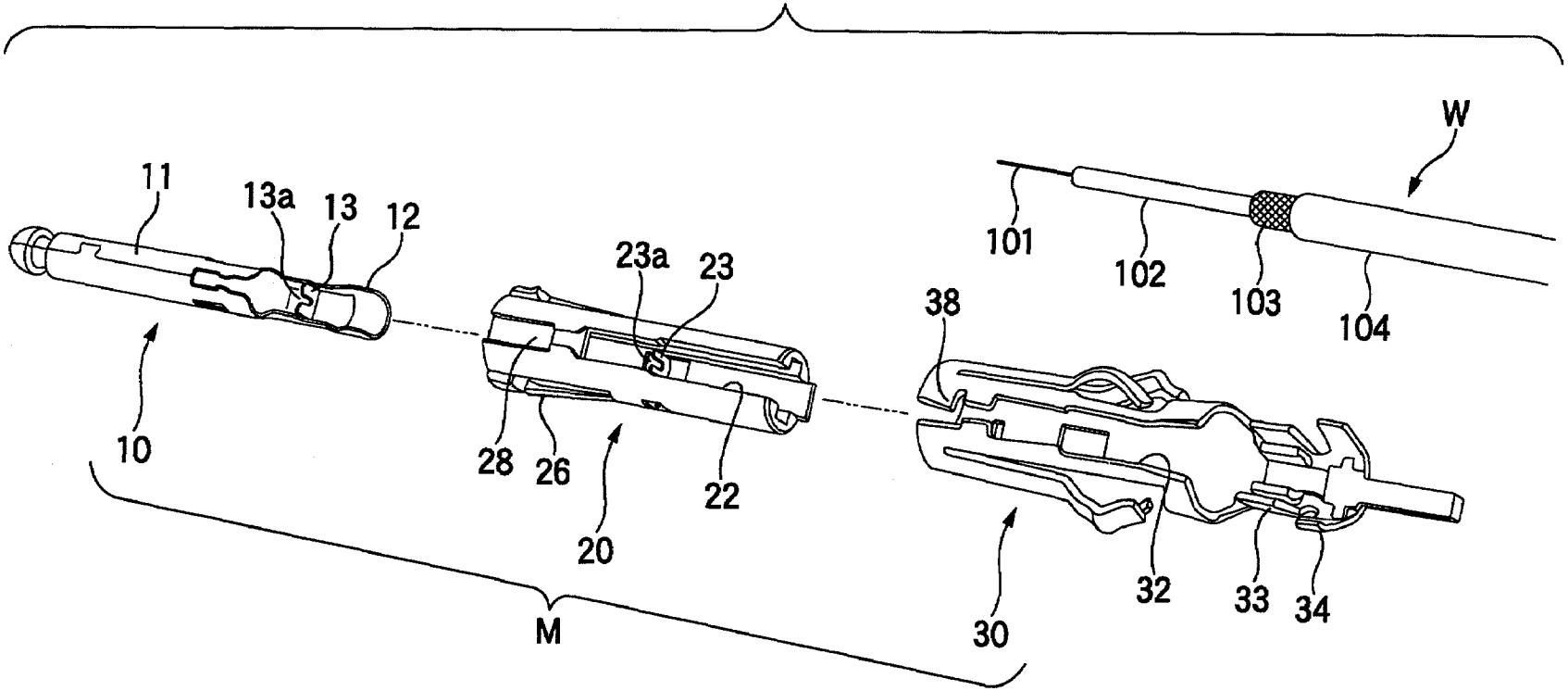
FIG. 1 is a perspective view of a preferred embodiment of a shield connector of the present invention as seen from the upper side, showing a condition before this shield connector is assembled.
Figure 2:
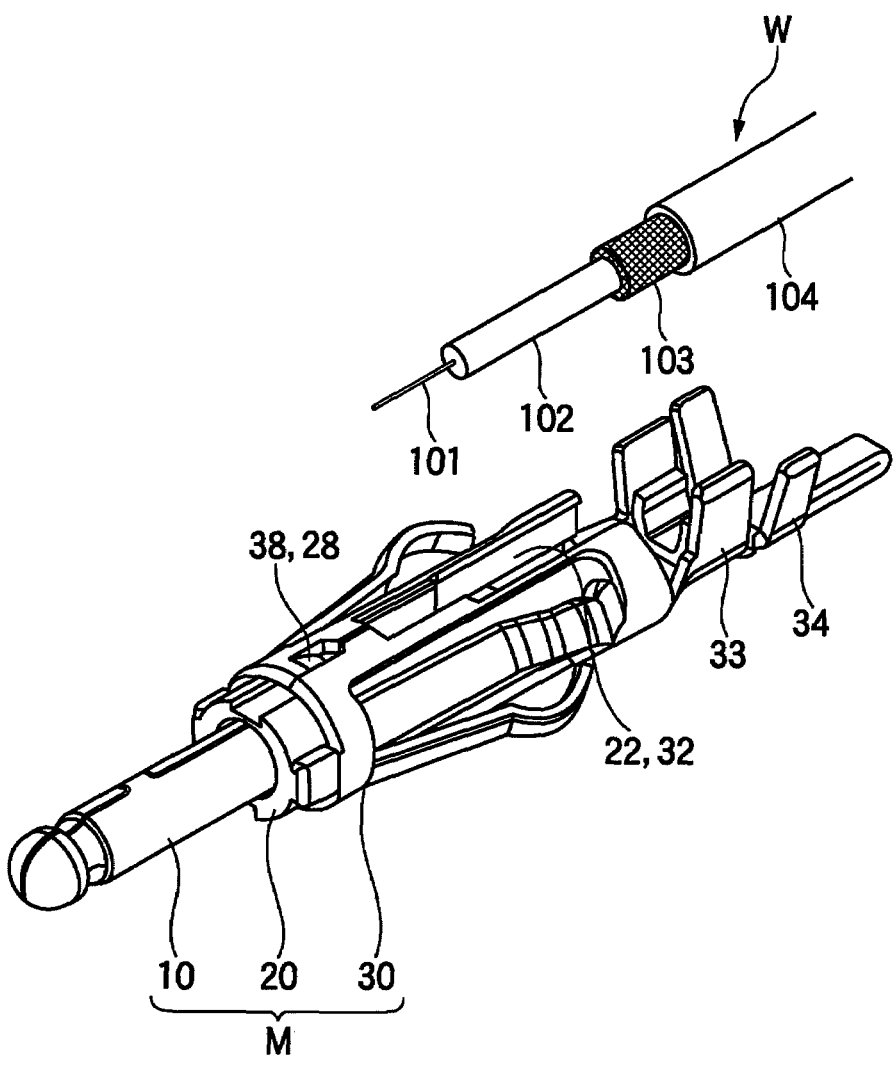
FIG. 2 is a perspective view showing a condition in which a shielded cable is to be connected to the assembled shield connector.
Figure 3:
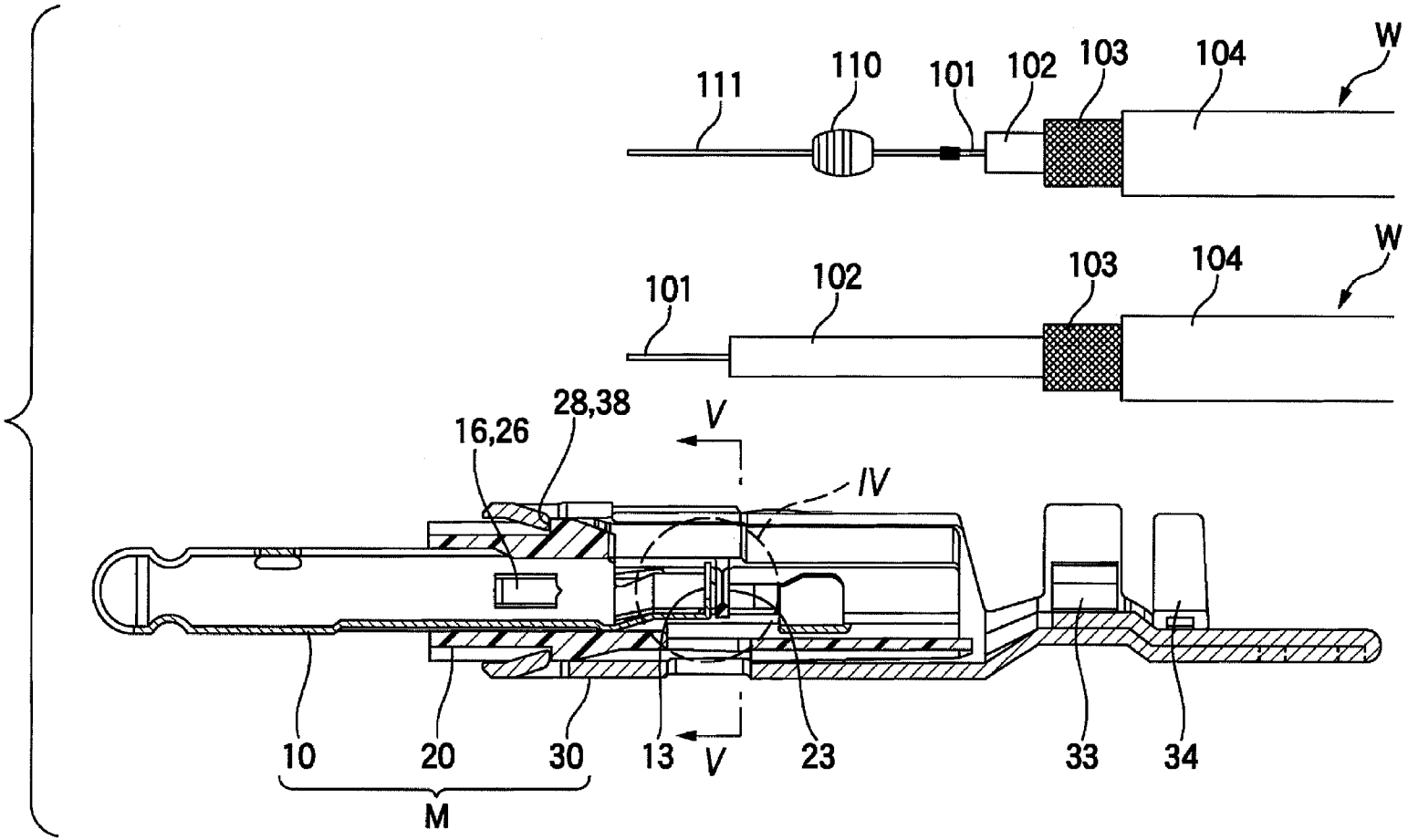
FIG. 3 is a longitudinal cross-sectional view of the assembled shield connector, showing the relation between this shield connector and the shielded cable to be connected thereto.
Figure 4:
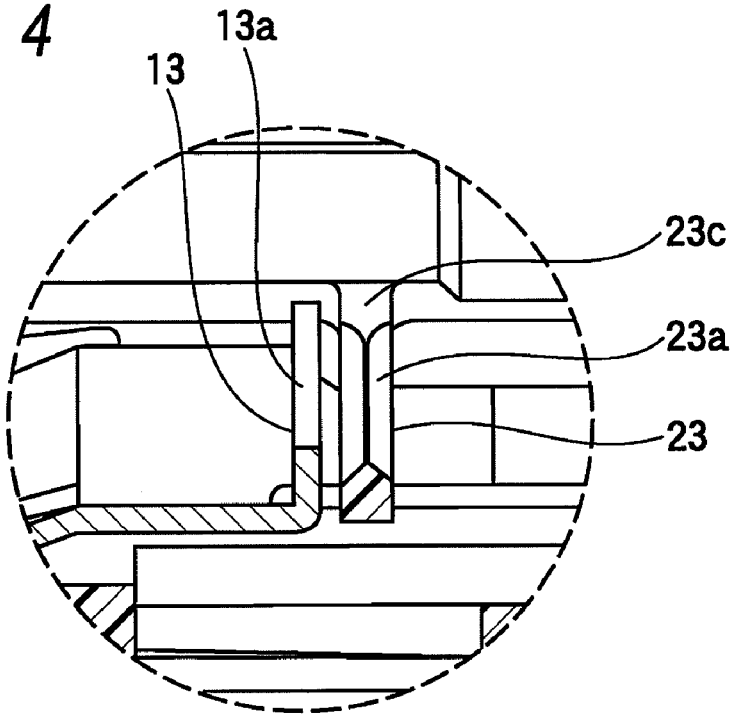
FIG. 4 is an enlarged view of a portion IV of FIG. 3.
Figure 5:
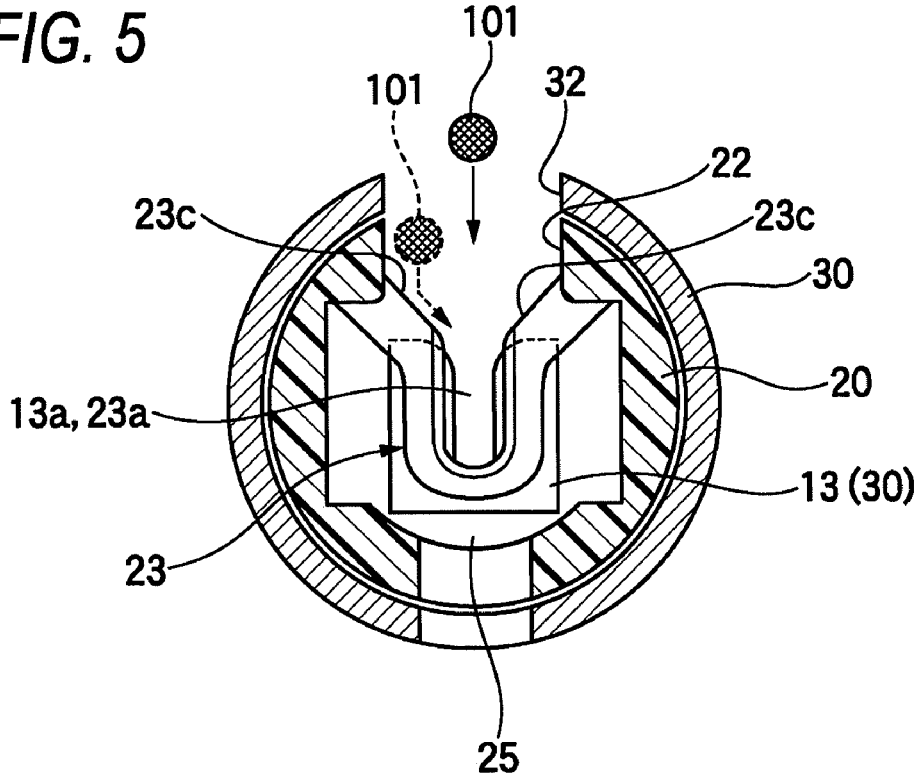
FIG. 5 is a cross-sectional view taken along the line V-V of FIG. 3.
Figure 6:
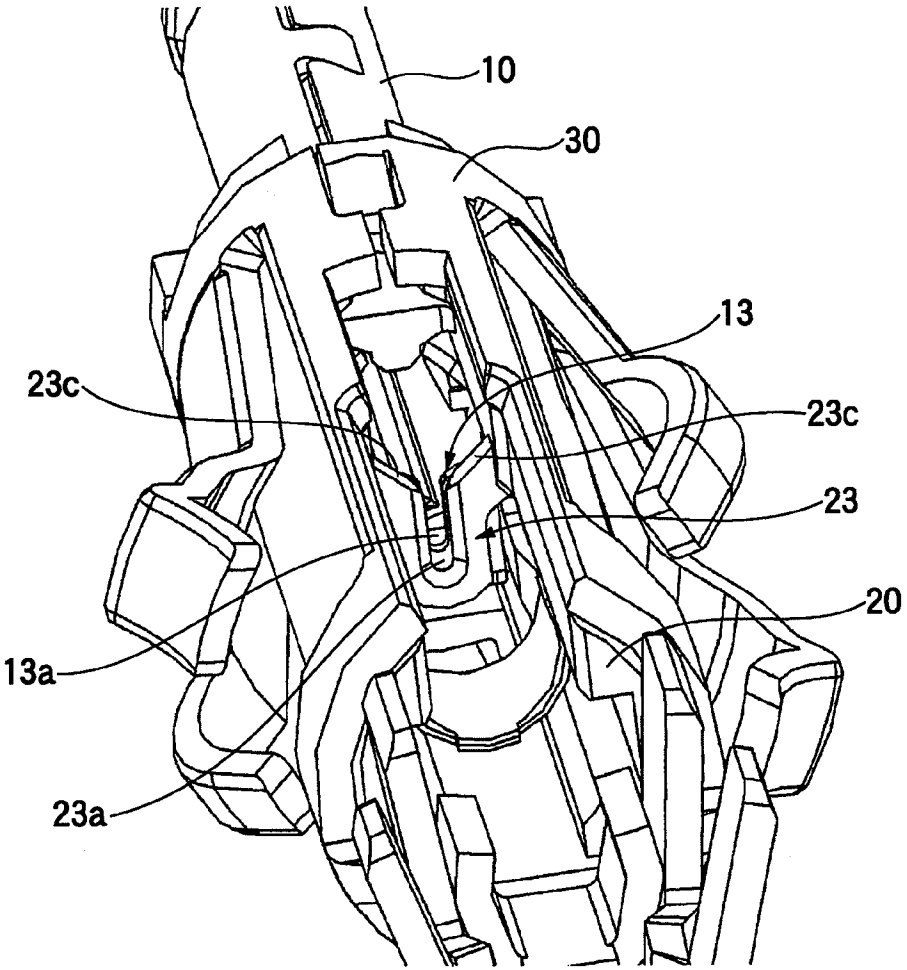
FIG. 6 is a perspective view of the portion shown in FIG. 5 as seen obliquely from the upper side in a direction from the rear side.
Figure 7:
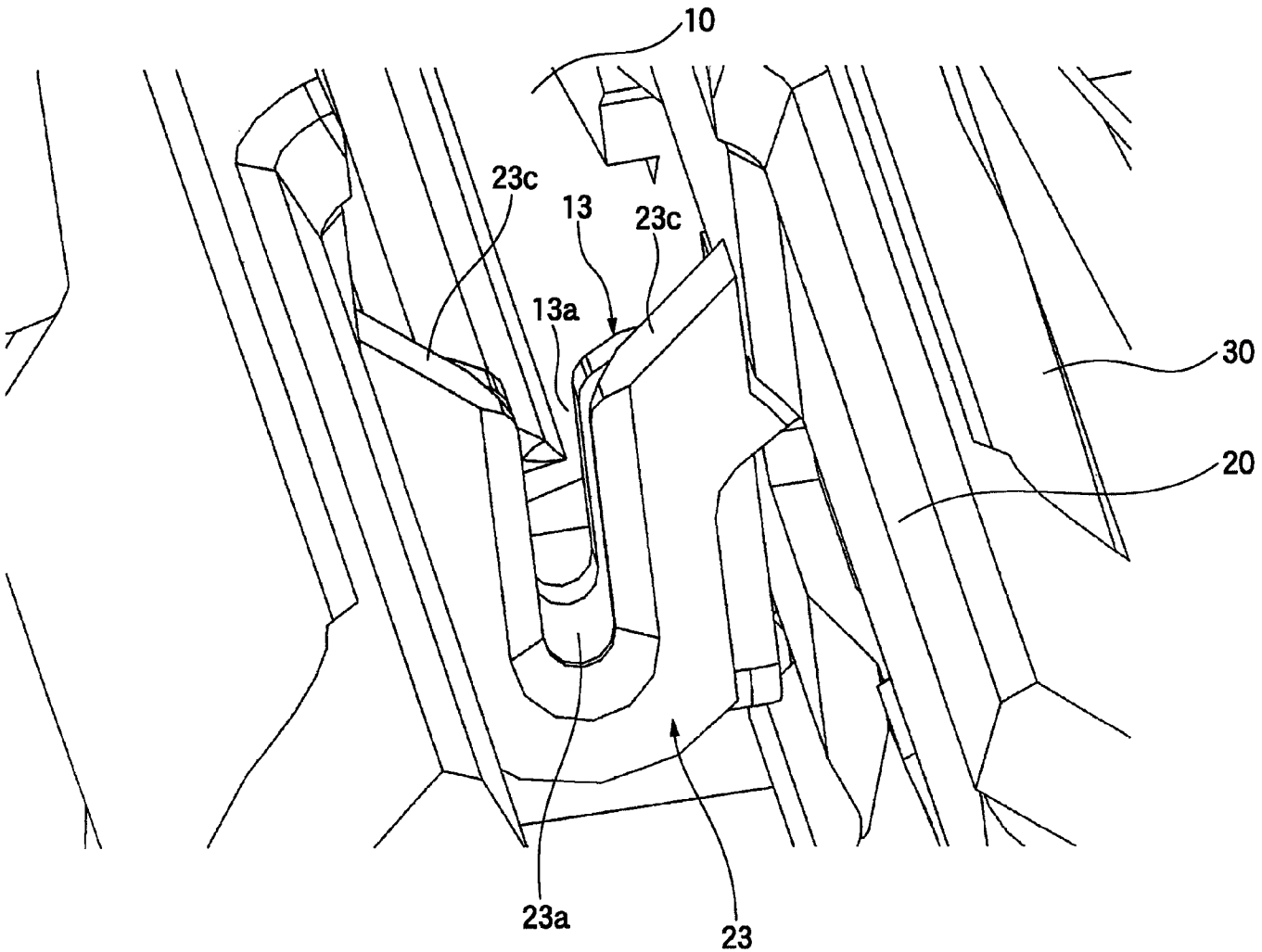
FIG. 7 is an enlarged view of an important portion of FIG. 6.
Figure 8:
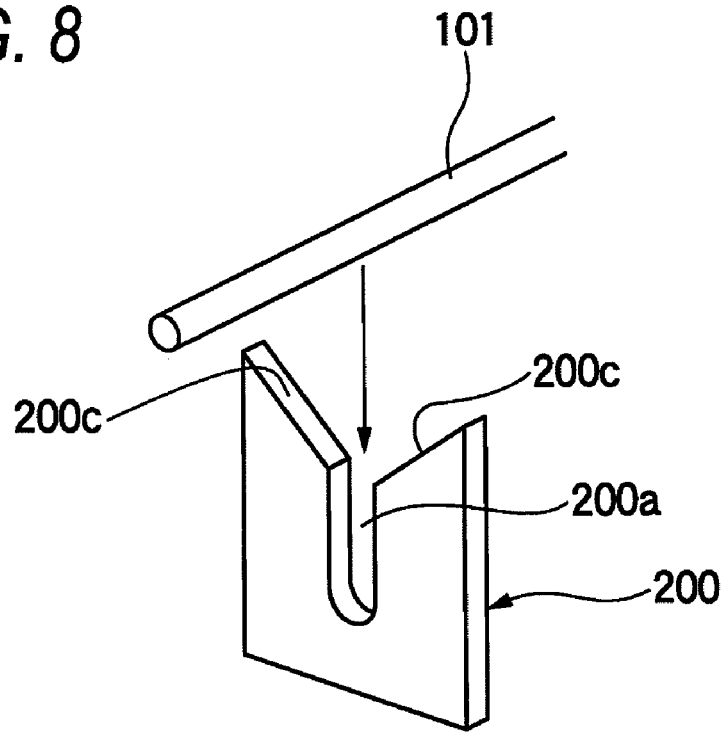
FIG. 8 is a perspective view of a conventional press-contacting blade of the ordinary type.
Figure 9:
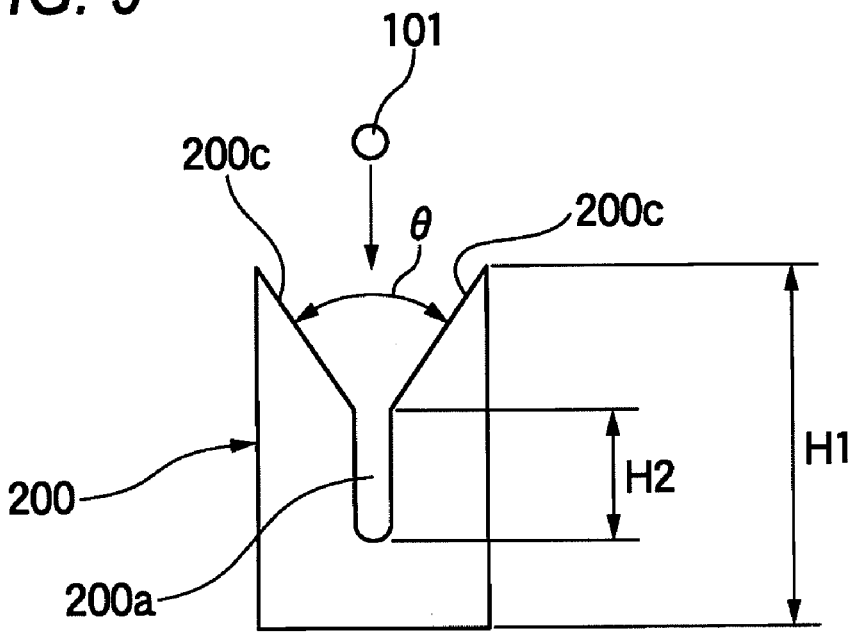
FIG. 9 is a view explanatory of a problem with the conventional press-contacting blade.

FIG. 1 is a perspective view of one preferred embodiment of a shield connector of the invention as seen from the upper side, showing a condition before this shield connector is assembled, FIG. 2 is a perspective view showing a condition in which a shielded cable is to be connected to the assembled shield connector, FIG. 3 is a longitudinal cross-sectional view of the assembled shield connector, showing the relation between this shield connector and the shielded cable to be connected thereto, FIG. 4 is an enlarged view of a portion IV of FIG. 3, FIG. 5 is a cross-sectional view taken along the line V-V of FIG. 3, FIG. 6 is a perspective view of the portion shown in FIG. 5 as seen obliquely from the upper side in a direction from the rear side, and FIG. 7 is an enlarged view of an important portion of FIG. 6.

As shown in FIGS. 1 to 3, the shielded cable W (the coaxial cable in this embodiment) to be connected to the shield connector includes a shielding conductor (a braided wire or the like) 103 provided on an outer periphery of a core wire (conductor) 101 (disposed at a central axis of the cable) through an insulator 102, and a sheath 104 covering an outer periphery of the shielding conductor 103. As shown in FIG. 3, there are occasions when a capacitor 110 is connected to a distal end portion of the core wire 101, and like the core wire 101, a terminal 111 of the capacitor 110 is connected in a press-contacted manner to the shield connector. Here, for description purposes, the terminal 111 should be considered as an extension of the core wire 101.

The shield connector M of this embodiment comprises an inner metal terminal 10 for connection to the core wire 101, a tubular resin sleeve 20 (made of a dielectric) receiving the inner metal terminal 10 therein, and a tubular outer metal terminal 30 receiving the resin sleeve 20 therein and adapted to be connected to the shielding conductor 103. Actually, the shield connector M further includes an outer case (not shown) covering an outer periphery of the outer metal terminal 30.

The inner metal terminal 10 is formed of a metal sheet bent into a cylindrical tubular shape, and therefore has a plug-like shape, and a front half portion of this inner metal terminal 10 in the longitudinal direction thereof serves as an inserting connection portion 11 for connection to a mating connector, while a rear half portion thereof is formed into an upwardly-open semi-tubular portion 12. A press-contacting blade 13 having a central slot 13*a* is formed on an inner bottom surface of the semi-tubular portion 12, with an inlet of the central slot 13*a* directed upwardly. The core wire 101 can be brought into press-contacting connection with the press-contacting blade 13 from the upper side through a slit-like opening 32 (formed in an upper portion of a peripheral wall of the outer metal terminal 30) and a slit-like opening 22 formed in an upper portion of a peripheral wall of the resin sleeve 20.

As shown in FIGS. 3 to 7, a support wall 23 is formed integrally with the tubular resin sleeve 20, and is disposed within this resin sleeve 20. When the inner metal terminal 10 is received within the resin sleeve 20, the support wall 23 is disposed adjacent to the press-contacting blade 13. This support wall 23 is formed into a U-shaped frame-like configuration, and is supported at its upper both ends on an inner surface of the resin sleeve 20, and hangs down therefrom. A space 25 is secured at the lower side of the support wall 23, and when the rear half portion of the inner metal terminal 10 is inserted into the resin sleeve 20 from the front side thereof, the semi-tubular portion 12 passes through this space 25.

The support wall 23 formed at the resin sleeve 20 has the function of guiding the core wire 101 and also has the function of supporting the core wire 101, and a guide portion is provided at this support wall 23. When the core wire 101 is to be press-fitted into the central slot 13*a* of the press-contacting blade 13 from the upper side, this guide portion contacts the core wire 101 so as to guide the core wire 101 into the central slot 13*a* before the press-contacting blade 13 contacts the core wire 101. Namely, a vertical groove 23*a* serving as this guide portion is formed in a widthwise-central portion of the support wall 23, and is disposed in registry with the central slot 13*a* of the press-contacting blade 13. A pair of inclined guide surfaces 23*c* jointly assuming a generally V-shape are formed at an inlet of the vertical groove 23*a*, and are disposed at a position higher than the press-contacting blade 13 such that the inclined guide surfaces 23*c* can contact the core wire 101 so as to guide the core wire 101 into the central slot 13*a* of the press-contacting blade 13 before the press-contacting blade 13 contacts the core wire 101.

When assembling the shield connector, first, the rear half portion of the inner metal terminal 10 is inserted into the resin sleeve 20 from the front side thereof, and is fixed to this resin sleeve 20, and then the resin sleeve 20 is inserted into the outer metal terminal 30 from the front side thereof, and is fixed to this outer metal terminal 30. At this time, lock portions 26 of the resin sleeve 20 are engaged respectively with retaining portions 16 of the inner metal terminal 10, and lock portions 38 of the outer metal terminal 30 are engaged respectively with retaining portions 28 of the resin sleeve 20, and as a result the resin sleeve 20 as well as the inner metal terminal 10 is prevented from withdrawal. In this condition, the core wire 101 of the shielded cable W can be brought into press-contacting connection with the press-contacting blade 13 of the inner metal terminal 10 through the opening 32 (formed in the peripheral wall of the outer metal terminal 30) and the opening 22 formed in the peripheral wall of the resin sleeve 20. Press-fastening portions 33 for clamping the shielding conductor 103 and press-fastening portions 34 for clamping the sheath 104 are formed at a rear end portion of the outer metal terminal 30.

When the shielded cable W is to be connected to the shield connector M, first, the end portion of the shielded cable W from which the insulator 102, the shielding conductor 103 and the sheath 104 have been suitably removed is located above the shield connector M. Then, the shielded cable W, while kept parallel to the shield connector M, is moved downward toward the shield connector M, and the core wire 101 is fitted into the central slot 13*a* of the press-contacting blade 13. At this time, even if the core wire 101 is disposed slightly out of position, the core wire 101 can be guided into the central slot 13*a* by the inclined guide surfaces 23*c* formed on the support wall 23 of the resin sleeve 20. After the core wire 101 is thus guided into the central slot 13*a*, a press-contacting punch is moved downward to press-fit the core wire 101 into the central slot 13*a*. Also, the press-fastening portions 33 are press-fastened to the shielding conductor 103, and the press-fastening portions 34 are press-fastened to the sheath 104. Thus, the connection of the shielded cable W to the shield connector M is completed.

As described above, in this embodiment, the support wall 23 is formed integrally with the resin sleeve 20 receiving the inner metal terminal 10 therein, and is disposed adjacent to the press-contacting blade 13. The inclined guide surfaces 23*c* assuming the generally V-shape are formed on the support wall 23, and when press-fitting the core wire 101 into the central slot 13*a* of the press-contacting blade 13 from the upper side thereof, the inclined guide surfaces 23*c* contact the core wire 101 so as to guide the core wire 101 into the central slot 13*a* of the press-contacting blade 13 before the press-contacting blade 13 contacts the core wire 101. Therefore, the core wire 101 can be smoothly guided into the central slot 13*a* of the press-contacting blade 13 without the need for providing any inclined guide surface on the press-contacting blade 13 itself.

Therefore, the height of the press-contacting blade 13 itself can be reduced, and the inner metal terminal 10 can be reduced in cross-sectional dimensions. And besides, the straight portion of the central slot 13*a* does not need to be sacrificed, and therefore the connecting performance for the core wire 101 will not be lowered. Furthermore, the core wire 101 can be guided into the central slot 13*a* of the press-contacting blade 13 by the inclined guide surfaces 23*c* of the resin-made support wall 23, and therefore damage of the core wire 101 due to die wear of the press-contacting blade 13 formed by pressing can be prevented.

Furthermore, by setting the angle between the pair of inclined guide surfaces 23*c* (assuming the generally V-shape) to a proper value, the easiness of the guiding of the core wire 101 into the central slot 13*a* can be determined. Furthermore, the core wire 101 is supported by the central slot 13*a* of the press-contacting blade 13 and the vertical groove 23*a* of the support wall 23, and therefore the core wire 101 can be supported in a more stable manner.

Furthermore, the space 25 for the insertion of the inner metal terminal 10 thereinto is secured at the lower side of the U-shaped frame-like support wall 23, and therefore when mounting the inner metal terminal 10 in the resin sleeve 20, the rear half portion of the inner metal terminal 10 can be inserted into the resin sleeve 20 from the front side thereof, and therefore the efficiency of this mounting operation is high. Furthermore, the inner metal terminal 10 and the resin sleeve 20 are mounted in the outer metal terminal 30, and in this condition the core wire 101 of the shielded cable W can be press-contacted with the press-contacting blade 13 of the inner metal terminal 10, and therefore the operation for connecting the shielded cable W can be easily effected.

The present invention is not limited to the above embodiment, and suitable modifications, improvements, etc., can be made. Furthermore, the material, form, number, disposition, etc., of each of the constituent elements of the above embodiment are arbitrary and are not limited in so far as the invention can be achieved.

What is claimed is:

1. A shield connector for a shielded cable including a shielding conductor provided on an outer periphery of a core wire through an insulator, and a sheath covering an outer periphery of the shielding conductor, the shield connector comprising:

an inner metal terminal which connects to the core wire of the shielded cable:

a tubular resin sleeve which receives the inner metal terminal therein, and has an opening portion;

a tubular outer metal terminal which receives the resin sleeve therein, has an opening portion, and is adapted to be connected to the shielding conductor, wherein a press-contacting blade is provided on the inner metal terminal, and is adapted to be brought into press-contacting connection with the core wire from an upper side through the opening portion of the outer metal terminal and the opening portion of the resin sleeve;

wherein a support wall is formed integrally with the resin sleeve, and is disposed adjacent to the press-contacting blade of the inner metal terminal in a state that the inner metal terminal is received in the resin sleeve;

wherein the support wall has a guide portion for guiding the core wire into a central slot of the press-contacting blade by contacting the core wire before the press-contacting blade contacts the core wire when the core wire is to be press-fitted into a central slot from the upper side; and wherein the guide portion includes a groove and an inclined surface formed at an inlet of the groove.

2. The shield connector according to claim 1, wherein the groove is formed in a widthwise-central portion of the support wall so as to correspond to the central slot of the press-contacting blade; and wherein a pair of inclined guide surfaces, which includes the inclined surface and another inclined surface, having a generally V-shape are formed at the inlet of the groove, and are disposed at a position higher than the press-contacting blade.

3. The shield connector according to claim 2, wherein the inner metal terminal is formed of a metal sheet bent into a cylindrical tubular shape, and a rear half portion of the inner metal terminal in a longitudinal direction thereof is formed into an upwardly-open semi-tubular portion, and the press-contacting blade is disposed within the upwardly-open semi-tubular portion, with an inlet of the central slot directed upwardly; and wherein the support wall is formed into a U-shaped frame in which upper both ends thereof is connected to an inner surface of the resin sleeve so the U-shaped frame is hanged down therefrom, and a space is formed at the lower side of the support wall so that the semi-tubular portion passes through the space when the rear half portion of the inner metal terminal is inserted into the resin sleeve from the front side thereof.

4. The shield connector according to claim 1, wherein the rear half portion of the inner metal terminal is inserted into the resin sleeve from the front side thereof, and is fixed to the resin sleeve, and the resin sleeve is inserted into the outer metal terminal from the front side thereof, and is fixed to the outer metal terminal, and in this condition the core wire of the shielded cable is brought into press-contacting connection with the press-contacting blade of the inner metal terminal through the opening portion of the outer metal terminal and the opening portion of the resin sleeve.

5. The shield connector according to claim 1, wherein the inclined surface is disposed at a position higher than the press-contacting blade.

6. The shield connector according to claim 1, wherein the inclined surface is disposed at a position higher than the central slot of the press-contacting blade.

* * * * *